United States Patent [19]

Roussel et al.

[11] Patent Number: 4,822,206

[45] Date of Patent: Apr. 18, 1989

[54] PARKING BARRIER

[75] Inventors: Xavier Roussel, Versailles, France; Elaine Silets, 34 E. Bellevue Pl., Chicago, Ill. 60611

[73] Assignee: Elaine G. Silets, Chicago, Ill.

[21] Appl. No.: 52,276

[22] Filed: May 21, 1987

[51] Int. Cl.[4] ..... E01F 13/00

[52] U.S. Cl. ..... 404/6; 404/10; 49/9

[58] Field of Search ..... 404/6, 9, 10, 11; 49/33, 49, 131; 256/1; 40/608; 104/252, 256; 188/32

[56] References Cited

U.S. PATENT DOCUMENTS

| | | | |
|---|---|---|---|
| 745,512 | 12/1903 | Nidermeyer | 104/256 |
| 1,907,158 | 5/1933 | Smith | 404/11 |
| 2,316,178 | 4/1943 | Morgensen, Jr. | 188/32 |
| 2,627,920 | 2/1953 | Barlow | 49/49 X |
| 2,737,740 | 3/1956 | Genoe | 49/131 X |
| 3,750,331 | 8/1973 | Renaux | 49/35 |
| 4,332,503 | 6/1982 | Hurst, Jr. | 404/11 |

FOREIGN PATENT DOCUMENTS

| | | | |
|---|---|---|---|
| 2289678 | 5/1976 | France | 404/6 |
| 2568906 | 2/1986 | France | 49/33 |

*Primary Examiner*—Jerome W. Massie IV
*Assistant Examiner*—Matthew Smith
*Attorney, Agent, or Firm*—Lee & Smith

[57] ABSTRACT

A device for inhibiting parking or travel on pavement, comprising an elongated barrier member that is hingedly affixed to a support bolted or otherwise securely attached to the pavement. The barrier member can be oriented in two positions, one which the barrier member is prone to allow traffic to pass thereover, and a second which the barrier member is essentially upright to inhibit travel. A brace extends between the barrier member and the support and resiliently retains the barrier member in the upright orientation to absorb the impact of a vehicle.

19 Claims, 2 Drawing Sheets

80
76
7.
58
54
44
9.
60
62
52
64
74
6.
6.
56
68
78
80
8.
82
72
8.
98
9.
28
28
84
86
42
50
48
42
46
88
88
20
46
48
7.

28
44
28
52
58
80
76
72
62
68
5.
56
74
5.
78
60
54

44
66
74
54
58
68
56
52
62
72
98
98
50
20
42
88
46
48
28

40
42
40
46
56
82
98
46
50
88
88
48
84
98
48
86
20

54
44
58
60
74
66
52
62
70
68
42

78

34
36
38
32

PARKING BARRIER

BACKGROUND OF THE INVENTION

This invention relates to control of vehicular traffic, and in particular to a barrier or barricade that can be raised to inhibit travel or can be lowered to permit travel thereover.

Parking barriers or barricades are quite common, and are found most often in locations to reserve parking places or inhibit travel along a roadway or other paved sufaces. Such devices typically comprise two portions, a support that is bolted or otherwise attached to the pavement, and a barrier portion that can be oriented in a lowered, horizontal position to allow traffic to pass thereover, or in a raised, upright position to preclude any traffic from passing thereover. In the upright position, the device acts as a rigid barrier, and if hit, will either be damaged, or will damage the vehicle striking it, or both.

SUMMARY OF THE INVENTION

The invention provides a collapsible and cushioned barricade composed of a fixed, generally horizontal support adapted to be secured to the roadway, and an elongated barrier member secured to the support. The barrier member is pivotally secured to the support so that the barrier member may be positioned in one of two orientations, a first orientation where the barrier member is essentially prone and a second orientation where the barrier member is essentially upright. A brace extends between the barrier member and the support, with the brace being fixedly secured to the barrier member and to the support when the barrier member is upright. When upright, the brace also includes means for resiliently permitting temporary displacement of the barrier member if struck.

In accordance with the disclosed embodiment of the invention, the brace has one end that is hingedly secured to the support and includes means slideably securing the other end of the brace to the barrier member. When in the upright orientation, also provided is a means for fastening the brace to the barrier member, comprising a latch mounted on the barrier member and a latch engagement element mounted on the brace in registration with the latch. A latch release is mounted adjacent to the latch, and a lock is provided for inhibiting the latch release, and therefore preventing the barrier from being unlocked from the upright position.

For the sliding engagement of the brace within the barrier member, a pair of spaced channels are secured to the barrier member, and a pin, attached to the brace, is engaged in the channels. For aligning the latch engagement element with the latch, the latch engagement element includes at least one leg that also extends outwardly into one of the channels in the barrier member.

The brace provides temporary pivotal displacement of the barrier member about its hinged attachment to the support. The brace includes a spring which will absorb compression or extension if the upright barrier member is struck. A shock absorber is employed in combination with the spring to dampen the action of the spring and also provide limits to the deflection of the upright barrier member, when the brace is locked in place.

BRIEF DESCRIPTION OF THE DRAWINGS

The invention is described in greater detail in the following description of an example embodying the best mode of the invention, taken in conjunction with the drawings, in which.

DESCRIPTION OF AN EXAMPLE EMBODYING THE BEST MODE OF THE INVENTION

Figure 1:
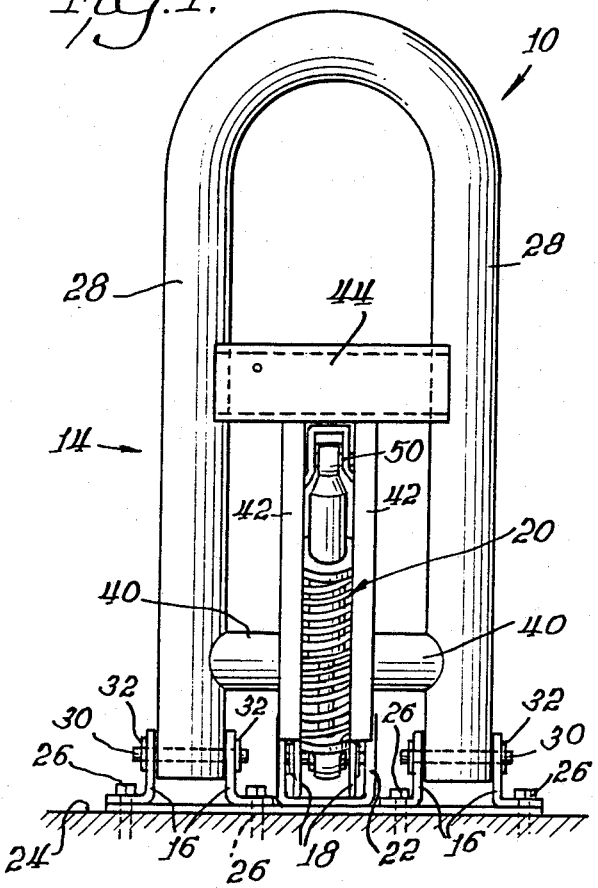
FIG. 1 is an end elevational view of the parking barrier according to the invention, when in the upright orientation.

The invention is generally designated at 10 in the drawing figures, and comprises two basic components, a fixed, generally horizontal support 12 and an elongated barrier member 14 attached to one end of the support 12.

Figure 2:
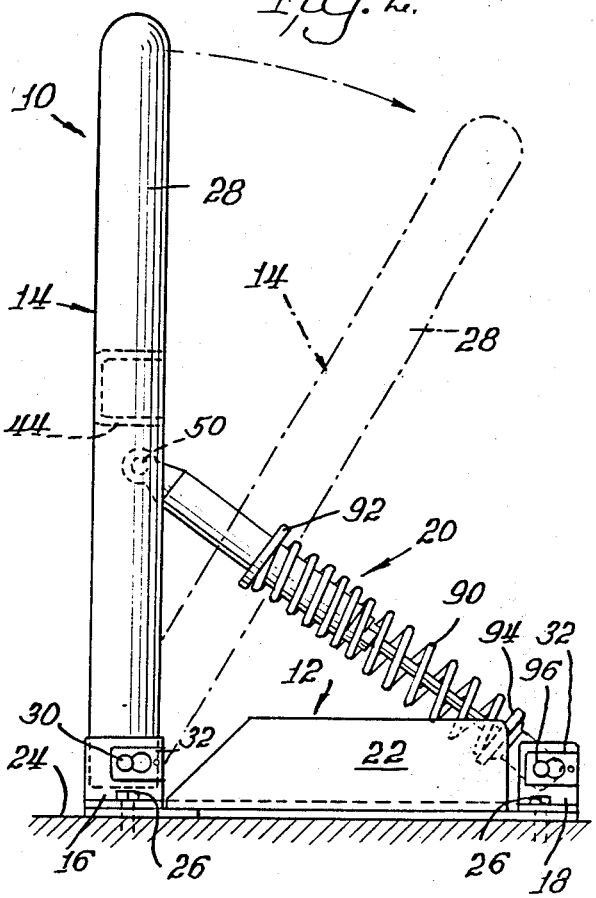
FIG. 2 is a side elevation illustration of the barrier illustrated in FIG. 1, showing also, in phantom, the degree to which the barrier can be deflected in one direction when struck.
Figure 3:
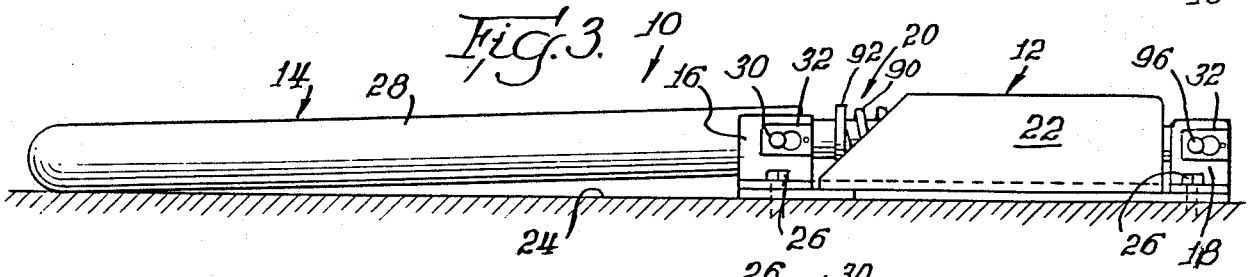
FIG. 3 is a side elevation illustration of the invention illustrated in FIGS. 1 and 2 when the barrier member is lowered to a first orientation that is essentially prone.
Figure 4:
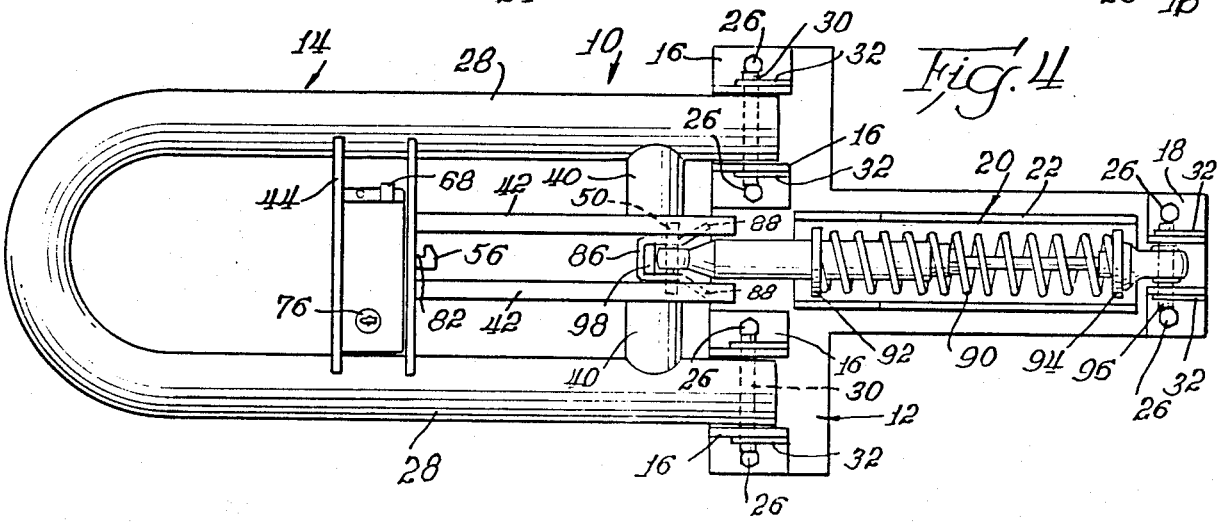
FIG. 4 is a top view of FIG. 3.

As best shown in FIGS. 2 through 4, the support 12 is a generally horizontal, T-shaped member having upstanding brackets 16 to which the barrier member is attached, as described in greater detail below. In addition, the support 12 includes upstanding brackets 18 to which a brace 20, also described in greater detail below, is attached. The support 12 also includes a channel 22 to protect the brace 20 when the barrier member 14 is in the prone orientation illustrated in FIGS. 3 and 4.

The support 12 is intended to be securely affixed to pavement 24 or any other surface to which the barricade 10 is be to attached. As illustrated in FIGS. 1 through 4, a series of bolts 26 are employed to securely affix the support 12 to the pavement 24. Other means of attachment, such as inserting the support in freshly-poured concrete, can be employed as well, although normally, the barricade 10 will be installed after the pavement 24 has been poured, if it is a solid material such as concrete, or laid, if it is macadam or paving materials, such as paving stones or blocks.

Figure 6:
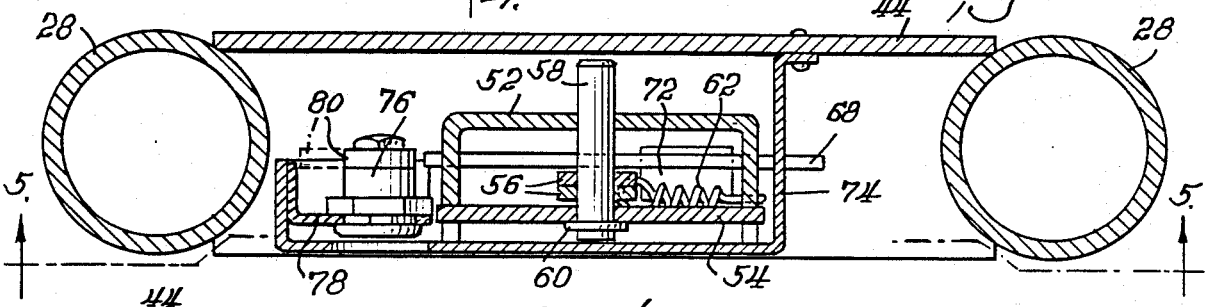
FIG. 6 is a cross-sectional view of the barrier member taken along lines 6—6 of FIG. 5.
Figure 7:
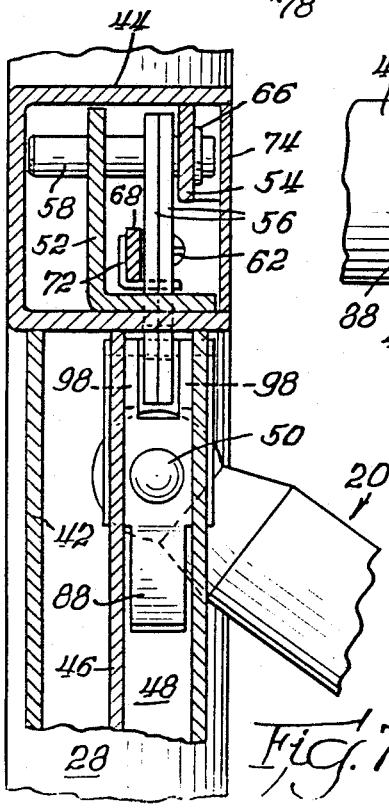
FIG. 7 is a cross-sectional view taken along lines 7—7 of FIG. 5.
Figure 8:
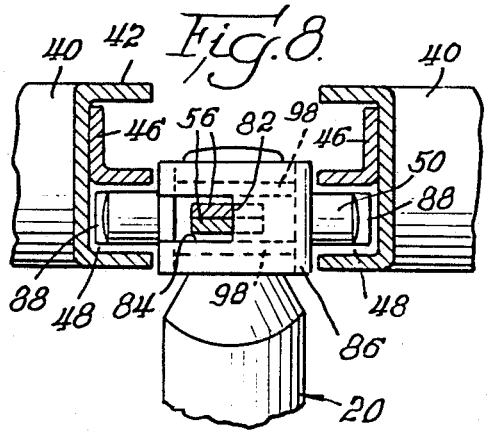
FIG. 8 is a cross-sectional view taken along lines 8—8 of FIG. 5.
Figure 11:
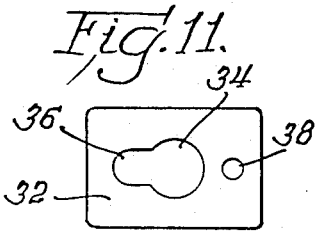
FIG. 11 is a plan view of a locking clip for several of the pins and axles of the invention.

The barrier member 14, is preferably comprises of a rigid, tubular material, such as metal, best shown in FIG. 6, and is composed of a pair of spaced tubes 28 joined in a continuous, arcuate fashion to form the barrier member 14. At their lower ends, each of the tubes 28 is pivotally secured to a respective pair of the brackets 16 by means of respective axle pins 30. The pins 30 permit free, pivotal rotation of the barrier member 14 in the brackets 16 between the upright orientation shown in FIGS. 1 and 2, and the prone orientation shown in FIGS. 3 and 4. The pins 30 are, in turn, retained in place by means of lock clips 32, best shown in FIG. 11. Although not shown in detail in the drawing figures, each of the axle pins 30 includes an annular channel near each of the ends thereof. The lock clips 32 include an enlarged aperture 34 dimensioned slightly larger than the diameter of the pins 30 in order to pass readily thereover, and a smaller keyway 36, extending from the aperture 34, which is dimensioned to engage the annular channel in each end of the pins 30. When installed, a lock clip 32 is inserted with the aperture 34 over an axle pin 30, and then shifted laterally to engage the keyway 36 within the corresponding annular channel formed in the axle pin 30. When thus shifted, the lock clip 32 can be retained in place by riveting through a hole 30, or can be otherwise permanently affixed, as desired.

For added strength and stability, the barrier member 14 also includes a cross brace 40 extending between the spaced tubes 28. For additional rigidly, further cross braces can be employed, although normally additional braces will be unnecessary if the material of the tubes is sufficiently substantial.

The brace 20 extends between the brackets 18 and spaced pin channels 42 which are secured in the barrier member to the cross brace 40 and a latch mount 44. Each of the channels 42 includes an internal divider 46 defining a sub-channel 48 for a pin 50 secured horizontally through the top of the brace 20. The pin may therefore slideably traverse the sub-channels 48 as the barrier member 14 is raised and lowered, described in somewhat greater detail below.

The latch mount 44 carries a locking assembly composed of an internal bracket 52 carrying a cross brace 54. A pair of latches 56 are mounted on a latch pin 58 which passes through and is supported by the internal bracket 52 and the cross brace 54. A lock ring 60 secures the latchpin 58 in place.

Figure 9:
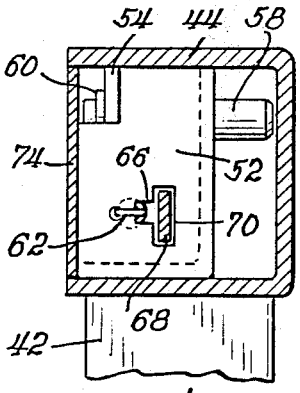
FIG. 9 is a cross-sectional view of FIG. 5 taken along lines 9—9.
Figure 10:
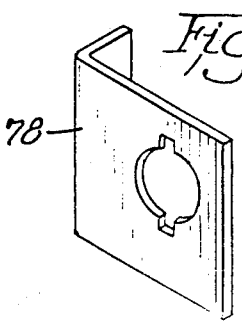
FIG. 10 is a perspective view of a mount for the lock for the invention.

The latches 56 are spring-biased by a spring 62 secured at one end through an aperture 64 in one of the latches 56 and with its other end passing through a notch 66 in the wall of the bracket 52. A slide-type latch release 68 is mounted adjacent the latches 56 through apertures in the opposite side walls of the bracket 52 (aperture 70 only being illustrated in FIG. 9). The latch release 68 includes a contact member 72 which, as best seen in FIG. 6, is immediately adjacent the latches 56, and when the latch release 68 is shifted to the left, in FIG. 6, pivots the latches 56 about the pin 58, against the force of the spring 62. Also, because the contact member 72 is sandwiched between the latches 56 and one wall of the internal bracket 52, the contact member 72 also prevents the latches 56 from rotating too far to the right (with relation to FIGS. 5 and 6).

As illustrated, one end of the latch release 68 extends through the aperture 70 and through a further cover plate 74, and therefore is acessible to the user of the barricade 10. In order to preclude one from unauthorized use of the latch release 68, a lock 76 is located within the latch mount 44, situated on a further bracket 78. The lock 76, which may be of a conventional key-tumbler design, includes an eccentric leg 80 which, as shown in FIG. 5, can be positioned to inhibit movement of the latch release 68, or can be rotated to a horizontal orientation to permit free movement thereof.

Figure 5:
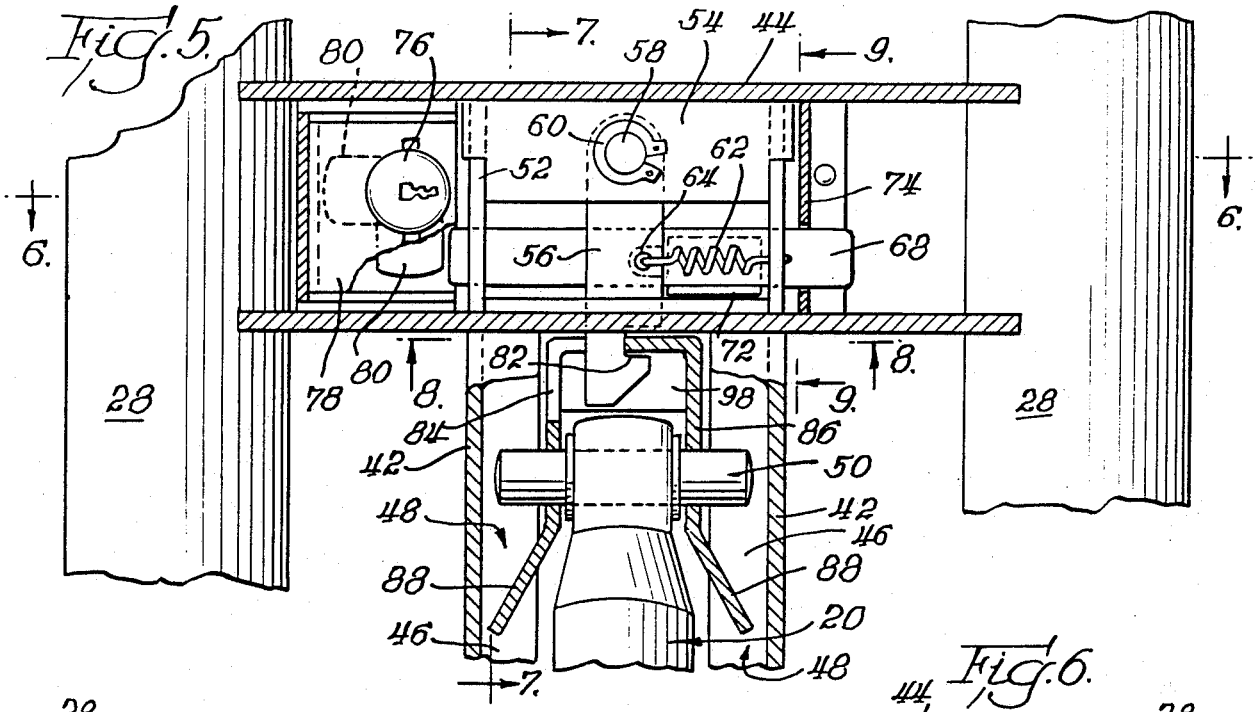
FIG. 5 is an enlarged view of a portion of the barrier member, partially in cross section in the vicinity of the locking means, as taken along lines 5—5 of FIG. 6.

The latches 56 are notched at 82 and engage a corresponding opening 84 formed in the top of a latch engagement element 86 which, as best illustrated in FIG. 5, is engaged on the pin 50. For proper alignment of the latch engagement element 86, depending legs 88 extend outwardly therefrom into the sub-channels 48.

The brace 10 may be composed of a conventional shock absorber. A spring 90, extending between fixed collars 92 and 94, is employed to retain the brace 20 in a normal rest extension shown in FIGS. 2 and 4. The brace 20 is pivotally secured to the brackets 18 by means of a pin 96 held in place on opposite sides by a pair of the lock clips 32.

In use, when the travel-prevention feature of the barricade 10 is not desired, the barrier member 18 is rotated about the pins 30 to the prone orientation shown in FIGS. 3 and 4. Vehicular traffic can quite readily pass over the barricade 10 in this orientation. Furthermore, if the barricade 10 is used in climates where snow may accumulate and snow plowing is required, the entire barricade can be installed in a depression in the pavement, thus not interferring with snow plowing activities.

As the barrier member 14 is raised to the upright orientation shown in FIGS. 1 and 2, the pin 50 slides upwardly in the sub-channels 48. When the full upright position has been reached, the latches 56 engage the opening 84 in the latch engagement element 86, and snap into place, being held against release by means of the spring 62. If the lock 76 is unlocked (with the leg 80 horizontal), the latch release 68 may be used to release the latches 56 from the latch engagement element 86. However, if the lock 76 is locked (with the leg 80 vertical), the latch release 68 is inhibited from movement, and therefore the latches 56 remain in place, biased by the spring 62, and the barrier member 14 is locked in place in the upright orientation. Plates 98 are installed in the latch engagement element 86 to assure that locking of the latch release 68 is not circumvented by direct access to the latches 56.

The brace 20, which is retained in its extended position by the spring 90, maintains the barrier member in a normally vertical orientation. If the barrier member is struck, however, the spring 90 cushions the blow, allowing the barrier member 14 to pivot about the pins 30, as shown in phantom in FIG. 2. The barricade 10 is therefore cushioned against blows, yet the barrier member 14 will normally remain upright and return to the upright position after a blow.

Because the latches 56 are spring-loaded, the lock 76 need not be unlocked in order to raise the barrier member 14 to the upright orientation and lock it in place. Thus, raising the barrier member 14 from the prone position shown in FIGS. 3 and 4 to the upright orientation shown in FIGS. 1 and 2 is quite simple, involving less time than were one required to use a key to lock the barrier member 14 in the upright orientation.

When struck, the barrier member 14 will deflect only a certain amount before the full extend of compression of the shock absorber of the brace 20 has been reached. If struck by a vehicle with such great force that the barrier member 14 is deflected to that extent, the vehicle may, if traveling fast enough, be raised off the roadway, and suspended or "hung up" on the barrier member 14. While such instances undoubtly will be quite rare unless the barricade 10 is purposely struck, a vehicle thus suspended by the barricade 10 would be trapped and would require extraction by a crane or towing vehicle.

As explained above, the material of the barricade 10 is preferably metal. However, sufficiently rigid plastics or other materials could be employed, so long as sufficient bearing strength is present.

Various changes can be made to the invention without departing from the spirit thereof or scope of the following claims.

What is claimed is:

1. A collapsible, cushioned barricade comprising a. a fixed, generally horizontal support, b. an elongated barrier member, c. hinge means pivotally securing said barrier member to said fixed support so that said barrier member may be positioned in one of two orientations, a first orientation where said barrier member is essentially prone and a second orientation where said barrier member is essentially upright, and d. a brace extending between said barrier member and said support, said brace being slidably secured to said barrier member and pivotally secured to said support such that when said barrier member is in said second orientation said brace is inclined relative to said barrier member, and said brace including resilient means permitting temporary displacement of said barrier member by compression of said brace when said barrier member is in said second orientation, said resilient means further returning said barrier member to said second orientation after such temporary displacement.

2. A barricade according to claim 1 in which said brace is hingedly secured to said support and including means slideably securing said brace to said barrier member.

3. A barricade according to claim 2 including means for fastening said brace to said barrier member when said barrier member is in said second orientation.

4. A barricade according to claim 3 in which said fastening means comprises a latch mounted on said barrier member and a latch engagement element mounted on said brace in registration with said latch.

5. A barricade according to claim 4 including a latch release mounted adjacent said latch, and including means for inhibiting said latch release.

6. A barricade according to claim 5 in which said means for inhibiting comprises a lock.

7. A barricade according to claim 2 in which said means slideably securing comprises a pair of spaced channels secured to said barrier member and a pin engaged in said channels, said pin being attached to said brace.

8. A barricade according to claim 7 including a latch mounted on said barrier member and a latch engagement element mounted on said pin, said latch being shaped to engage said latch engagement element to maintain said barrier member in said second orientation, and including means for aligning said latch engagement element with said latch.

9. A barricade according to claim 8 in which said means for aligning comprises at least one leg extending from said latch engagement element into one of said channels.

10. A barricade according to claim 1 in which said resilient means permits temporary pivotal displacement of said barrier member about said hinge means, and comprises a spring forming a part of said brace.

11. A barricade according to claim 10 including means limiting displacement of said barrier member.

12. A barricade according to claim 11 in which said limiting means comprises a fluid cylinder.

13. A collapsible, cushioned barricade comprising a. a fixed, generally horizontal support, b. an elongaed barrier member, c. hinge means pivotally securing said barrier member to said fixed support so that said barrier member may be positioned in one of two orientations, a first orientation where said barrier member is essentially prone and a second orientation where said barrier member is essentially upright, and d. a movable brace extending between said barrier member and said support, said brace being pivotally secured to said support and including means slideably securing said brace to said barrier member, e. means for fastening said brace to said barrier member when said barrier member is in said second orientation with said brace being inclined relative to said barrier member, and f. resilient means associated with said brace for permitting temporary pivotal displacement of said barrier member about said hinge means by compression of said brace when said barrier member is in said second orientation, said resilient means further returning said barrier member to said second orientation after such temporary pivotal displacement.

14. A barricade according to claim 13 in which said fastening means comprises a latch mounted on said barrier member and a latch engagement element mounted on said brace in registration with said latch.

15. A barricade according to claim 13 in which said means slideably securing comprises a pair of spaced channels secured to said barrier member and a pin engaged in said channels, said pin being attached to said brace.

16. A barricade according to claim 15 including a latch mounted on said barrier member and a latch engagement element mounted on said pin, said latch being shaped to engaged said latch engagement element to maintain said barrier member in said second orientation, and including means for aligning said latch engagement element with said latch.

17. A barricade according to claim 13 in which said resilient means comprises a spring forming a part of said brace.

18. A barricade according to claim 17 in which said brace includes a shock absorber which limits displacement of said barrier member.

19. A collapsible, cushioned barricade comprising a. a fixed, generally horizontal support, b. an elongated barrier member, c. hinge means pivotally securing said barrier member to said fixed suport so that said barrier member may be positioed in one of two orientations, a first orientation where said barrier member is essentially prone and a second orientation where said barrier member is essentially upright, d. a movable brace extending between said barrier member and said support, said brace being pivotally secured to said support and including means slideably securing said brace to said barrier member, e. means for fastening said brace to said barrier member when said barrier member is in said second orientation with said brace inclined relative to said barrier member, and f. said brace including resilient means for permitting temporary pivotal displacement of said barrier member about said hinge means when said barrier member is in said second orientation, said resilient means comprising a compressible fluid cylinder and a spring surrounding said cylinder for returing said barrier member to the second orientation after such temporary pivotal displacement.

* * * * *